US010399835B2

(12) United States Patent
Geilsdorf et al.

(10) Patent No.: US 10,399,835 B2
(45) Date of Patent: Sep. 3, 2019

(54) METHOD FOR INCREASING THE OPERATING STABILITY OF AN INDUSTRIAL TRUCK

(71) Applicant: Jungheinrich Aktiengesellschaft, Hamburg (DE)

(72) Inventors: Hendrik Geilsdorf, Hamburg (DE); Jörn Sellentin, Kaltenkirchen (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 15/719,931

(22) Filed: Sep. 29, 2017

(65) Prior Publication Data

US 2018/0086614 A1 Mar. 29, 2018

(30) Foreign Application Priority Data

Sep. 29, 2016 (DE) ..... 10 2016 118 457

(51) Int. Cl.

| | |
|---|---|
| ***B66F 9/20*** | (2006.01) |
| ***G05G 5/03*** | (2008.04) |
| ***G05G 5/04*** | (2006.01) |
| ***G05G 5/05*** | (2006.01) |
| ***B66F 17/00*** | (2006.01) |
| ***B66F 9/075*** | (2006.01) |
| ***G05G 9/047*** | (2006.01) |

(52) U.S. Cl.

CPC ..... *B66F 17/003* (2013.01); *B66F 9/0759* (2013.01); *B66F 9/20* (2013.01); *G05G 5/03* (2013.01); *G05G 5/04* (2013.01); *G05G 5/05* (2013.01); *G05G 9/047* (2013.01); *G05G 2505/00* (2013.01)

(58) Field of Classification Search

CPC ..... B66F 17/003; B66F 9/0759; B66F 9/20; G05G 5/03; G05G 5/04; G05G 5/05; G05G 9/047; G05G 2505/00

See application file for complete search history.

(56) References Cited

U.S. PATENT DOCUMENTS

| | | | | |
|---|---|---|---|---|
| 6,109,130 | A | 8/2000 | Will | |
| 8,781,642 | B2 | 7/2014 | Tarasinski | |
| 2008/0275596 | A1* | 11/2008 | Tarasinski | E02F 9/2004 701/1 |
| 2009/0234518 | A1* | 9/2009 | Irwin, III | B64C 13/10 701/4 |

(Continued)

FOREIGN PATENT DOCUMENTS

| | | | |
|---|---|---|---|
| DE | 19753867 | A1 | 6/1999 |
| DE | 10015707 | A1 | 10/2001 |

(Continued)

*Primary Examiner* — Aaron L Troost
(74) *Attorney, Agent, or Firm* — Barclay Damon LLP

(57) ABSTRACT

A method for operating an industrial truck having an operating element comprising at least one operating lever and a resetting apparatus configured to interact with the at least one operating lever comprises generating resetting force that is dependent on a deflection of the least one operating lever. Determining a vehicle variable indicating a tipping moment and changing the resetting force when a critical value of the vehicle variable exists for a tipping moment of the industrial truck, wherein the resetting force increases as the tipping moment increases.

11 Claims, 4 Drawing Sheets

(56) References Cited

U.S. PATENT DOCUMENTS

| | | | |
|---|---|---|---|
| 2015/0033899 | A1 | 2/2015 | Geilsdorf et al. |
| 2015/0268691 | A1 | 9/2015 | Schaub et al. |

FOREIGN PATENT DOCUMENTS

| | | | |
|---|---|---|---|
| DE | 10304658 | A1 | 8/2004 |
| DE | 102005012004 | A1 | 10/2005 |
| DE | 102005000633 | A1 | 7/2006 |
| DE | 102007021499 | A1 | 11/2008 |
| DE | 10213012176 | A1 | 1/2015 |
| DE | 102014103988 | A1 | 9/2015 |
| WO | 2016019091 | A1 | 2/2016 |

* cited by examiner

METHOD FOR INCREASING THE OPERATING STABILITY OF AN INDUSTRIAL TRUCK

CROSS REFERENCE TO RELATED INVENTION

This application is based upon and claims priority to, under relevant sections of 35 U.S.C. § 119, German Patent Application No. 10 2016 118 457.8, filed Sep. 29, 2016, the entire contents of which are hereby incorporated by reference.

The invention relates to a method for operating an industrial truck with an operating element, and an industrial truck with the operating element.

BACKGROUND

Numerous different concepts and approaches for operating elements are known for operating and controlling industrial trucks. For example, a control element for an industrial truck is known from DE 10 2013 012 176 that has two operating levers and at least one switch arranged therebetween. The operating levers are each designed for a two-axial movement and are spatially separate from each other such that the fingers of a hand positioned between the levers can actuate the operating levers without grasping, and can actuate the at least one switch between the operating levers.

DE 10 2005 000 633 A1 has disclosed providing vibrations in the control element and/or the driver's seat as feedback for vehicle states and/or vehicle information. This is haptic feedback of vehicle states and/or vehicle information. When the control element is embodied as a joystick, there is reliable and direct feedback of vehicle states and/or vehicle information by electromagnets generating vibrations, or an electric motor interacting with an unbalanced mass.

Control elements designed as a joystick are known from DE 10 2014 103 988 A1 for controlling commercial vehicles, machines, work functions of commercial vehicles or construction machines and attachments. The use of force feedback is also known for the joysticks. Force feedback is mechanical feedback which is normally achieved by coupled torque of an electric motor with the assistance of a gear unit. Different technical embodiments of the actuating lever of the joystick are known for implementing force feedback.

A key aspect in the operation of an industrial truck is its stability. Variables that influence the stability are the load weight, distance from the load's center of gravity, lifting height and tilt of the mast. In addition to these static variables, there are dynamic processes that have an influence on stability such as braking, reverse acceleration, driving in a curve, etc. A number of different approaches are known for determining stability. In one approach, the force or pressure is measured at different positions of the vehicle. Other approaches such as those in DE 100 15 707 A1, DE 103 04 658 A1 or DE 10 2005 012 004 A1 are based on model-based considerations.

An operating lever for a vehicle or a working machine that has means for generating a resetting force was disclosed in laid-open application DE 197 53 867 A1. A stop is provided for the operating lever, and the resetting force is increased overproportionally depending on the deflection.

An operating lever was disclosed in WO 2016/019 091 A1 that transmits information to the user by an adjustable resetting force and adjustable vibrations.

The object of the invention is to provide a method for operating an industrial truck, as well as an industrial truck that prevents misuse from the standpoint of stability, even in difficult circumstances.

BRIEF SUMMARY OF THE INVENTION

The method according to the invention is provided and intended for operating an industrial truck with an operating element. The operating element has at least one operating lever that is preferably configured for movement along two axes. Moreover, a resetting apparatus is provided that may interact with the operating lever. The resetting apparatus is configured to generate a resetting force that counteracts the deflection depending on a deflection of the at least one operating lever. Force feedback can be generated by the resetting apparatus. The resetting force, which acts on the operating lever, can be changed depending on its respective deflection using the resetting apparatus. The change depends on the respective deflection means that a specified association between the deflection and resetting force is changed. If a certain value for the resetting force was associated with a value for the deflection before the change, this deflection value is assigned a changed value for the resetting force. In an embodiment, the method provides determining a vehicle variable that indicates tipping moment. The vehicle variable indicating the tipping moment can be determined depending on the selection and design with which the stability of the industrial truck is monitored. Depending on the value of the vehicle variable, the resetting force is changed when a critical value of the vehicle variable exists for a tipping of the industrial truck. In an embodiment, the vehicle driver is given haptic feedback on the vehicle variable indicating the tipping moment. It is particularly advantageous in this context that the haptic feedback can be perceived unhindered through the operating lever in contrast with a visible or acoustic warning by the vehicle, for example on a monitor, by signal lights or by acoustic signals.

In an embodiment, the resetting force may be changed so as to pulse, preferably periodically, when a critical value of the vehicle variable arises. In particular, the frequency of the periodically changing resetting force can be changed with the vehicle variable, wherein the frequency increases as the critical vehicle variable increases. Periodically changing the resetting force acting on the operating lever is a measure that particularly stimulates awareness to notify the vehicle driver of the critical vehicle state. There are no undesired deflections of the operating lever in contrast to a vibration, for example by mounting an electric motor with an imbalance. Pulsatingly changing the resetting force merely allows an operating person to be able to hold the operating lever in the desired position and thereby experience a pulsatingly changing resetting force without the person moving the operating lever, or the operating lever being moved.

In a further embodiment, the resetting force for the respective deflection is increased when an actuation of the at least one operating lever changes the vehicle variable toward an increase in the tipping moment. In this context, an "increase in the tipping moment" is not necessarily understood to mean a numerical increase of an effective torque, but rather in general that an increase in the tipping moment reduces stability. In an embodiment, the vehicle driver does not receive haptic feedback from the operating lever during regular operation. Instead, the re-setting force in the operating lever is adjusted so that, in the event of actuation of the operating lever which would cause a worsening of stability, haptic feedback occurs in this situation.

In an embodiment of the method according to the invention, the resetting force may be increased for the respective deflection starting at a predetermined value of the vehicle variable. The resetting force is preferably increased evenly in this case for each deflection of the operating lever. This means that the relationship between the deflection and resetting force is changed so that the resetting force is always increased for a given deflection. For the user, this may give rise to an impression of sluggishness in deflecting the operating lever. In this context, sluggishness means that a greater force must be overcome in order to overcome the resetting force when deflecting the operating level.

In another preferred embodiment, the resetting force may be increased by an additional force starting at a predetermined deflection upon a critical value of the vehicle variable such that an actuation of the at least one operating lever requires an increased exertion of force. In this embodiment, the predetermined deflection forms a hindrance with an additional force that prevents further actuation. However, by intentionally applying force, the operating person can overcome the additional force and move the operating lever further.

In another embodiment, the resetting force is increased by a locking force starting at a predetermined deflection at a critical vehicle variable such that further actuation of the at least one operating lever is impossible. In this embodiment, further actuation by applying greater force is impossible; however, an additional unlocking apparatus can be provided which, when actuated, enables further actuation of the at least one operating lever without the locking force. In principle, both embodiments can also be combined with each other, wherein first an overcomeable increase in the resetting force occurs, whereas the resetting force is increased either in the event of another critical vehicle variable or in the event of a different value for the predetermined deflection such that further actuation is impossible. The strongly increased resetting force can assume the function of an end stop which gives rise to a preferred end stop when the resetting force is strongly increased before reaching a maximum excursion.

In another embodiment of the method, the resetting force may be changed continuously or suddenly. The continuous change can be continuous over time, or continuous with the deflection of the operating lever.

In an embodiment, the industrial truck may comprise an operating element that has at least one operating lever and a resetting apparatus which interacts with the operating lever. The resetting apparatus generates a resetting force for the at least one operating lever depending on its deflection. The resetting force follows an assignment in which a resetting force is assigned to each occurring deflection. The industrial truck may also comprise a control unit that is configured to determine a vehicle variable indicating a tipping moment. Moreover, the resetting apparatus is configured to respond by changing the resetting force for a current deflection upon a vehicle variable value that is critical to the vehicle tipping over. The resetting apparatus may change the assignment between the deflection and resetting force depending on the given vehicle variable. This reliably notifies an operator of the industrial truck of the existence of a critical vehicle variable.

In an embodiment of the industrial truck, the resetting apparatus is configured to respond by increasing the resetting force for the current deflection based upon a vehicle variable, which causes the tipping moment to increase. If an activation occurs in a current deflection of the operating lever that causes the tipping moment to increase, the resetting force for this deflection is increased.

In an embodiment of the industrial truck, the resetting apparatus further comprises a pulse generator that changes a resetting force so as to pulsate starting at a critical value of the vehicle variable. The advantage of a pulsating change of the resetting force is that there are no undesired movements of the operating level upon restraining the deflection of the operating lever. Only a pulsation of the operating lever calls attention to the critical value of the vehicle variable.

In an embodiment, the pulse generator is configured to increase a pulse frequency of the pulsating resetting force in response to an increase in the tipping moment. The increasing frequency makes it clear that the stability of the industrial truck is endangered by further actuation.

In another embodiment, the resetting apparatus is configured to increase the resetting force for the respective deflection within a predetermined value if the vehicle variable is exceeded. In this case, the resetting force is increased when a predetermined value of the vehicle variable is exceeded.

In an embodiment of the industrial truck, the resetting apparatus is supplied with additional force starting at a predetermined deflection upon a reaching critical vehicle variable value. In this case, when the vehicle variable is or exceeds a critical value, there is an additional force to the resetting force. This additional force is applied when the deflection of the operating lever exceeds a predetermined deflection.

Instead of an additional force, a locking force can also be applied by the resetting apparatus. The locking force may render impossible a further actuation of the operating lever beyond the deflection.

In an embodiment, an unlocking apparatus interacts with the resetting apparatus. The resetting apparatus can be configured to eliminate the locking force in response to the unlocking apparatus.

BRIEF DESCRIPTION OF THE DRAWINGS

The method according to the invention will be further explained with reference to an example. In the following.

DETAILED DESCRIPTION OF THE INVENTION

Figure 1:
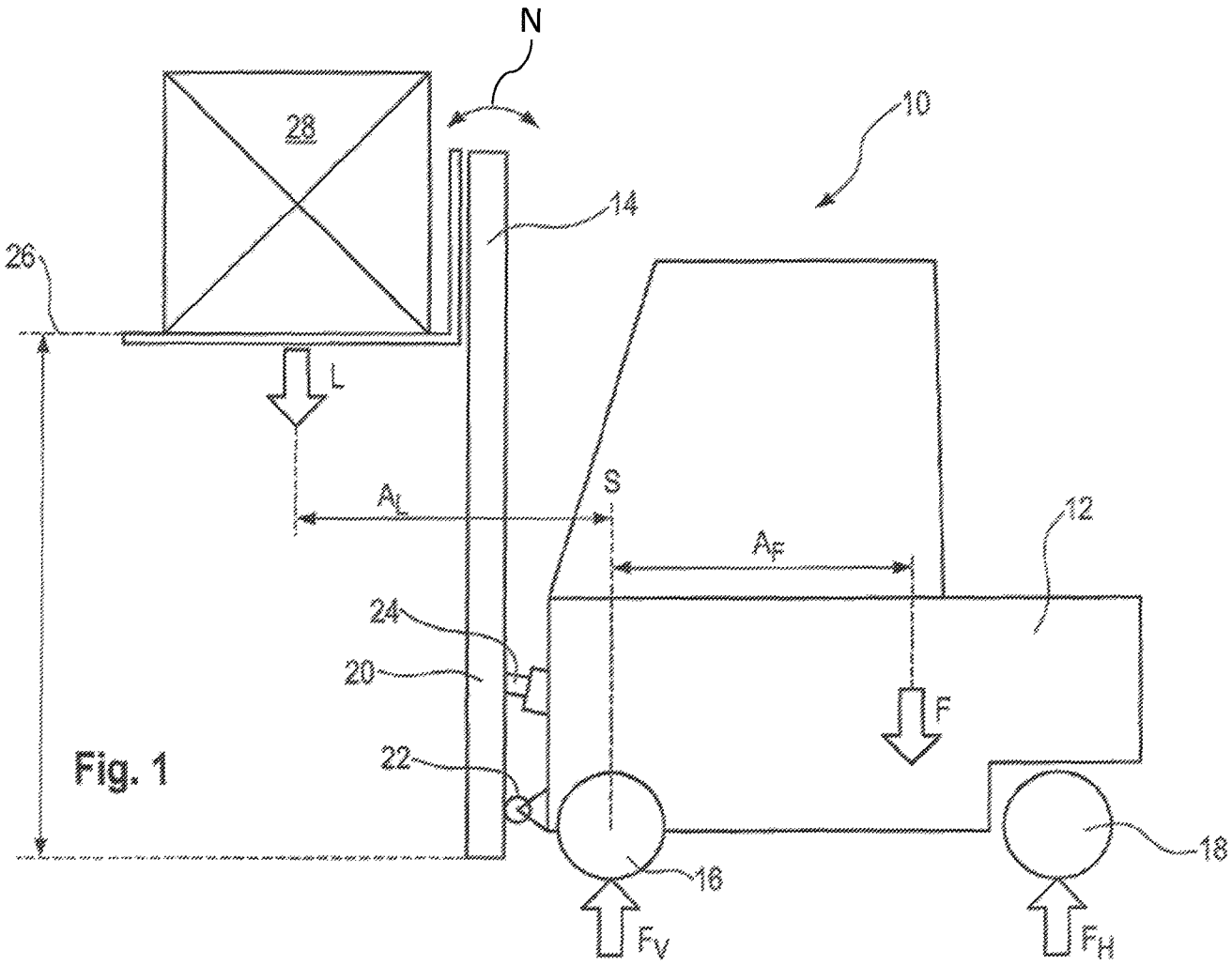
FIG. 1 illustrates a schematic view of an embodiment of an industrial truck.

FIG. 1 shows a schematic view of an industrial truck or counterbalance truck 10 which has a drive part 12 and a load part 14. The drive part 12 possesses two front wheels 16 and one or two rear wheels 18 depending on the design of the chassis. A tiltable lift mast 20 is coupled to the drive part 12 at a mast bearing 22 and can be tilted by a tilt cylinder 24 according to the double arrow N about the mast bearing 22. The lift mast 20 is equipped with a load bearing means 26, such as a load fork, on which a load 28 is schematically portrayed.

From a static perspective, the impinging load weight L and load distance AL from the vehicle's center of gravity S is relevant. This impinging load moment is opposed by the vehicle weight F and the distance AF from the vehicle's center of gravity S. Together, the load weight L and vehicle weight F generate the normal force FV at the front wheel 16. In a simple case in which the center of gravity S coincides with the front wheel 16, the normal force FV at the front wheel 16 is the same as the sum of the vehicle weight F and load weight L.

The normal force FH at the rear wheel 18 is crucial to the stability of the industrial truck 10. If the normal force FH, disappears, the industrial truck 10 can tip over on its front wheels 16 onto its load part 14.

There are various load moment sensors to determine the normal force FH at the rear wheel 18. For example, a load sensor can detect the load weight L on the load fork 26. It is also possible to detect forces impinging on the tilt cylinder 24. It is also possible in principle to detect the load moments on the mast bearing 22, for example with strain gauges or a force measuring bolt. Likewise, force can be measured at the rear axle of the rear wheel 18. Other approaches provide detecting one or more variables for the tip stability on the basis of a model.

Figure 2:
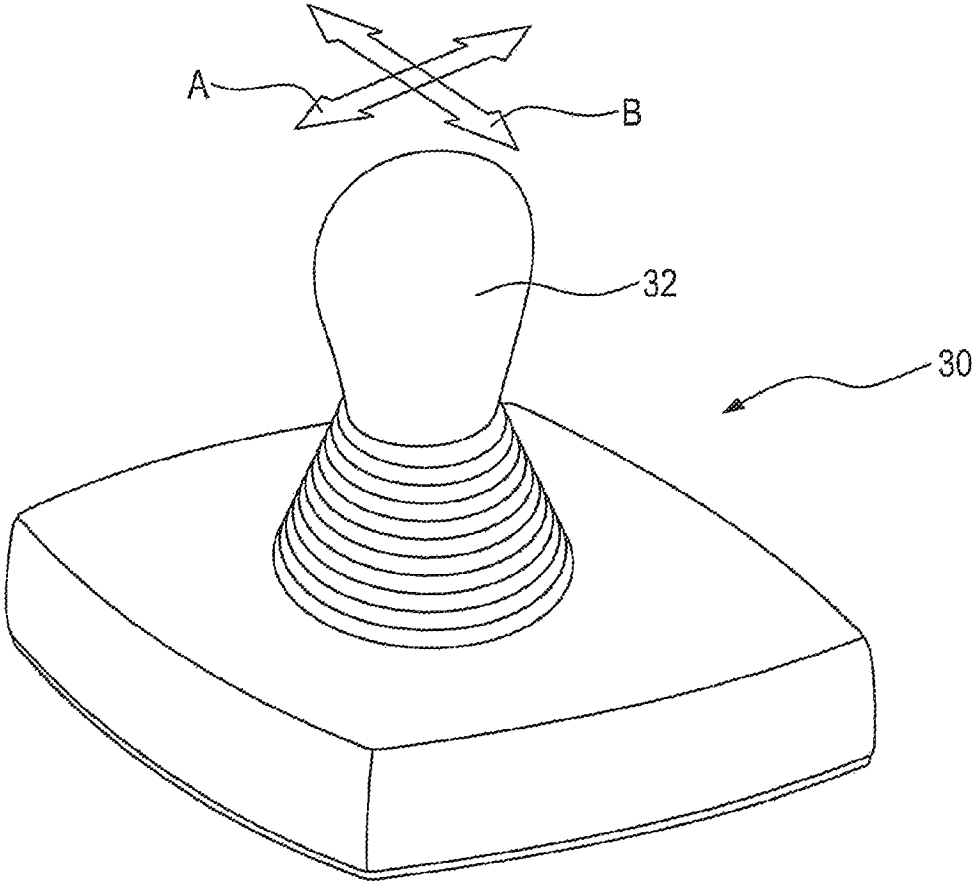
FIG. 2 illustrates a perspective view of an operating lever of an embodiment of an operating element of the industrial truck.

FIG. 2 shows an embodiment of an operating element 30 with an operating lever 32 that is configured to move independently along axes A and B. Generally, the operating lever 32 is seated securely in a center or neutral position and is pivoted independently along axes A or B. The operating lever 32 is pivoted out of the neutral position, both in a positive and a negative direction. The deflection of the operating lever 32 is restricted in either direction by a maximum deflection. The invention can of course also be used for an operating lever 32 that only pivots along one axis.

Figure 3:
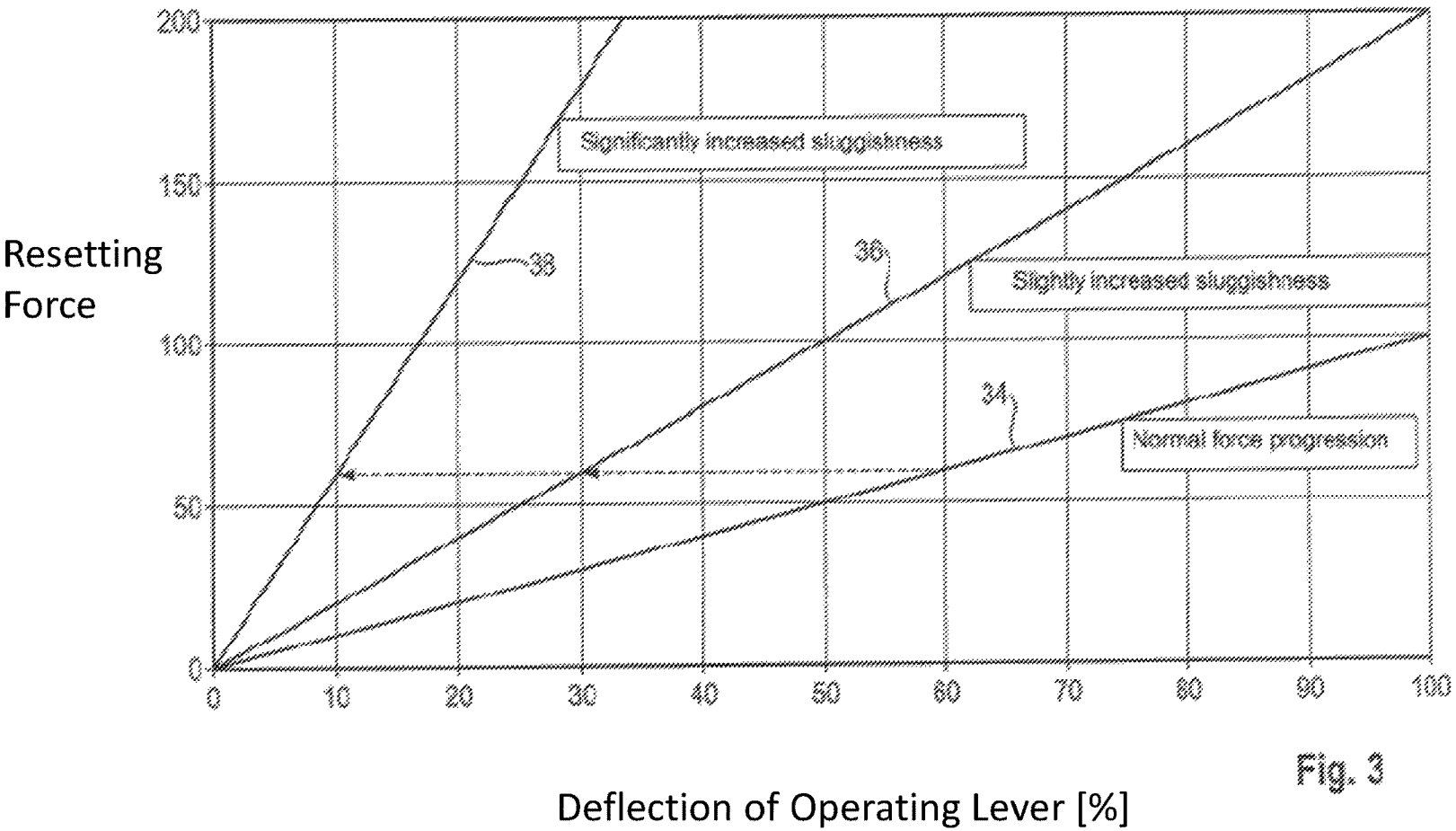
FIG. 3 illustrates the relationship between the resting force and the deflection of the operating lever of an embodiment of the operating element of the industrial truck.

FIG. 3 shows the relationship between the resetting force and the deflection of the operating lever 32. Like the resetting force, the deflection is scaled in percent arbitrary units. The neutral position of the operating lever 32 is at a deflection of 0. No resetting force exists in the neutral position. If the operating lever is deflected along the curve 34 for the normal progression of force, the resetting force increases with the deflection. The slope of the curve 34 indicates the possible ease or sluggishness of the operating lever 32. If a critical vehicle quantity for tipping over the vehicle is determined in the method according to the invention, the resetting force is increased. If the resetting force is increased, a linear progression between the resetting force and deflection is maintained with the difference, however, that greater resetting force is applied with the same deflection. The greater resetting force gives a user the impression that the operating leverage is more sluggish to use. Greater force must be applied for the same deflection as with a normal progression of force.

If the critical vehicle variable continues to change, the resetting force can be further increased until there is significantly elevated sluggishness with the curve progression 38.

The sluggishness of the operating element 30 is to make a user of the industrial truck 10 aware that the vehicle is being brought into a position which endangers stability.

Figure 4:
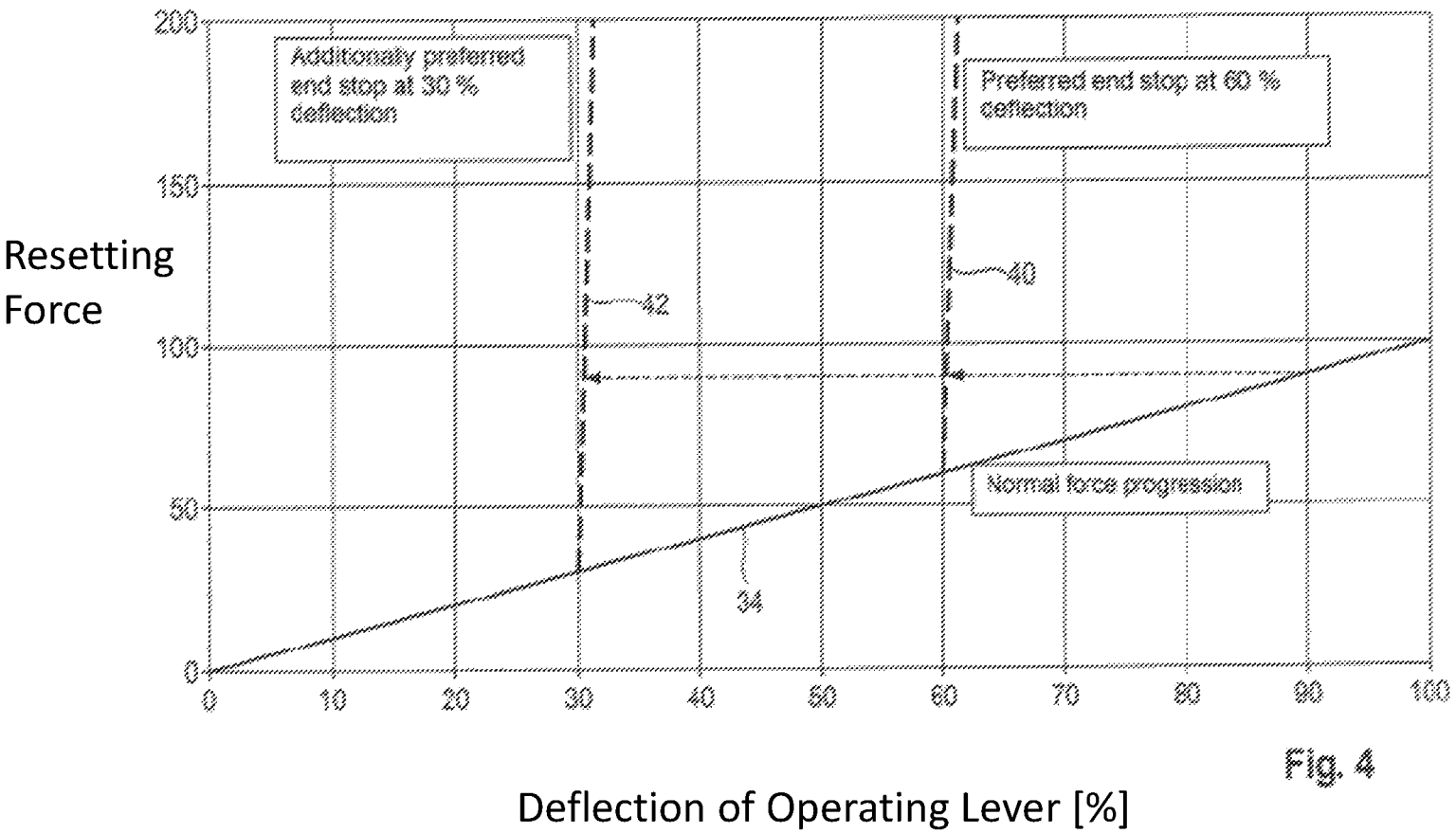
FIG. 4 illustrates an example of end stops of an embodiment of the operating element of the industrial truck.

Referring to FIG. 4, the curve 34 again reveals the normal force progression with a linear resetting force that reaches the value 100 with a 100% deflection. To generate preferred end stops, a steeply rising resetting force can be achieved at a deflection of 60% with the progression 40 by the resetting apparatus. In this manner, the operating lever can only be deflected up to 60%. If an even more critical vehicle variable exists, an end stop at 30% deflection can be defined. In this case, the resetting force rises along the curve 42.

It can be appreciated that there are different possibilities for notifying a vehicle driver of critical vehicle states. Visual notifications on screens and signal lights, acoustic notifications or vibrations of the operating element are known. The use of a resetting apparatus can ensure that the user can safely and reliably perceive the warning. In addition, the vehicle driver is not irritated by vibrations that are introduced externally into the operating element; instead the response of the operating element to a deflection of the operating lever changes in the form of the resetting force. It is possible for the resetting force to change pulsatingly or periodically when critical situations to the vehicle arise such that the user experiences a changing force when deflecting the operating lever, or respectively when maintaining the deflected position of the operating lever.

In another embodiment, an artificial sluggishness of the operating lever is generated continuously or suddenly starting at a critical state. Consequently while the same force is exerted by the user, the deflection of the operating lever decreases, and the critical movement is slowed. However, this gives the user the option of overriding the slowdown by exerting more force. Overriding is not possible when the end stops are shifted. This can also be continuous or sudden and causes the deflection of the operating element to decrease and thereby slows the critical movement. In this case, the user does not have the option of overcoming the reset end stop with force. Another option is to completely block an actuation of the operating lever 32. This corresponds to the characteristic curve 42 from FIG. 4, wherein the deflection is reduced to 0, or nearly 0.

In principle, a combination of the above options is also possible. For example, initially a pulsatingly changing resetting force can be generated that simultaneously or subsequently leads to increased sluggishness and then to a blockage of the operating lever.

In determining a vehicle variable that indicates a tipping moment, static variables such as load weight L, vehicle weight F and spacing of the centers of gravity S can in principle be included in the consideration. In addition, other vehicle states can be checked as well; for example, a load can only be lifted beyond a certain height when the mast 20 is tilted back even when the industrial truck 10 does not threaten to tip over for static reasons. It is moreover possible to include considerations of a forward tilt of the mast 20 in the vehicle variable. Once the load is lifted, or once it is above a certain height, certain movements that necessarily lead to a critical vehicle variable can be blocked, such as a forward tilt of the mast 20.

REFERENCE LIST

10 Counterbalance truck
12 Drive part
14 Load part
16 Front wheel
18 Rear wheel
20 Lift mast
22 Mast bearing
24 Tilt cylinder
26 Load bearing means
28 Load
30 Operating element
32 Operating lever
34 Curve progression
36 Curve progression

38 Curve progression
40 Curve progression
42 Curve progression

The invention claimed is:

1. A method for operating an industrial truck having an operating element comprising at least one operating lever and a resetting apparatus configured to interact with the at least one operating lever, the method comprising:

generating a resetting force that is dependent on a deflection of the least one operating lever;

determining a vehicle variable indicating a tipping moment;

changing the resetting force when a critical value of the vehicle variable exists for the tipping moment of the industrial truck;

increasing the resetting force as the tipping moment increases;

determining the critical value of the vehicle variable and increasing the resetting force by a locking force at a predetermined deflection such that it is impossible to further actuate the at least one operating lever against the locking force;

wherein the resetting force increases as the tipping moment increases.

2. The method according to claim 1, wherein the resetting force pulsatingly changes and the frequency of the pulsating resetting force increases as the tipping moment increases.

3. The method according to claim 1, wherein the resetting force for the deflection is increased when actuation of the at least one operating lever changes the vehicle variable toward an increase in the tipping moment.

4. The method according to claim 1, wherein the resetting force is increased for the deflection starting at a predetermined value of the vehicle variable.

5. The method according to claim 1, wherein upon determining the critical value for the vehicle variable, the resetting force is increased by an additional force at a predetermined deflection such that actuation of the at least one operating lever requires the additional force to be overcome.

6. The method according to claim 1, wherein the resetting force is changed continuously.

7. The method according to claim 1, wherein the resetting force is changed suddenly.

8. An industrial truck with an operating element comprising:

at least one operating lever;

a resetting apparatus configured to interact with the operating lever and generate a resetting force that is dependent on a deflection of the least one operating lever, the resetting apparatus further comprising a pulse generator configured to change the resetting force starting at a critical value of a vehicle variable and increase a frequency of the pulsating resetting force in response to an increase of a tipping moment; and a control unit configured to determine the vehicle variable indicating the tipping moment;

a control united configured to determine the vehicle variable indicating the tipping moment;

the resetting apparatus configured to change the resetting force for a current deflection in response to the vehicle variable value that is critical to the industrial truck tipping over; and upon determining the critical value of the vehicle variable, the resetting apparatus configured to increase the resetting force by a locking force at a predetermined deflection;

wherein the resetting apparatus is configured to lift the locking force in response to actuation of an unlocking apparatus.

9. The industrial truck according to claim 8, wherein the resetting apparatus increases the resetting force for the current deflection in response to a deflection that causes an increase in the tipping moment.

10. The industrial truck according to claim 8, wherein the resetting apparatus is configured to increase the resetting force for a deflection when a predetermined value of the vehicle variable is exceeded.

11. The industrial truck according to claim 8, wherein upon determining the critical value of the vehicle variable, the resetting apparatus is configured to supply the at least one operating level with an additional force at a predetermined deflection.

* * * * *